United States Patent [19]

Hays

[11] 4,370,056

[45] Jan. 25, 1983

[54] DEVELOPMENT SYSTEM

[75] Inventor: Dan A. Hays, Fairport, N.Y.

[73] Assignee: Xerox Corporation, Stamford, Conn.

[21] Appl. No.: 231,644

[22] Filed: Feb. 5, 1981

[51] Int. Cl.[3] ..... G03G 15/09

[52] U.S. Cl. ..... 355/3 DD; 118/653; 118/657; 355/3 BE

[58] Field of Search ..... 355/3 R, 3 DD, 3 BE, 355/16; 118/653, 657

[56] References Cited

U.S. PATENT DOCUMENTS

| | | | |
|---|---|---|---|
| 2,832,311 | 4/1958 | Byrne | 355/3 DD X |
| 3,678,895 | 7/1972 | Ohta et al. | 118/657 X |
| 3,692,402 | 9/1972 | Solarek | 355/3 DD |
| 4,013,041 | 3/1977 | Armstrong et al. | 118/656 |
| 4,194,830 | 3/1980 | Ohnuma et al. | 355/3 DD |
| 4,206,994 | 6/1980 | Silverberg et al. | 355/3 BE |

FOREIGN PATENT DOCUMENTS

| | | | |
|---|---|---|---|
| 52-73044 | 6/1977 | Japan | 355/3 DD |

OTHER PUBLICATIONS

Swapceinski; John, "Development Apparatus Which Compensates For Nap Contour Variations"; Research Disclosure Journal, Jul. 1979, p. 352, No. 18318.

*Primary Examiner*—Fred L. Braun

*Attorney, Agent, or Firm*—H. Fleischer; J. E. Beck

[57] ABSTRACT

An apparatus in which a belt transports developer material into contact with a rigid member in a development zone to develop a latent image recorded thereon. The belt is maintained at a pre-selected tension. In this way, the developer material is compressed and spaces the belt from the rigid member.

12 Claims, 3 Drawing Figures

DEVELOPMENT SYSTEM

This invention relates generally to an electrophotographic printing machine, and more particularly concerns an apparatus for developing a latent image.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two component mixture is brought into contact with the latent image. Toner particles are attracted from the carrier granules to the latent image forming a toner powder image thereof. Hereinbefore, it has been difficult to develop both the large solid areas and fine lines of the latent image. Different techniques have been employed to improve development of the latent image. For example, cascade systems, fur brush systems, magnetic brush systems and combinations of these systems have heretofore been utilized in electrophotographic printing machines. However, in all of the foregoing types of systems there continues to exist the problem of achieving uniform development for both the fine lines and large solid areas of the latent image. It has been extremely difficult to develop both the fine line image areas as well as the larger solid area while maintaining a minimum background density. Development can be improved by reducing the spacing between the photoconductive surface and the development system. However, in the case of rigid photoconductive members this is limited by the expense of reducing the tolerance accumulation between the rigid photoconductive member and the development system.

Various approaches have been devised to improve development. The following disclosures appear to be relevant:

U.S. Pat. No. 4,013,041; Patentee: Armstrong et al.; Issued: Mar. 22, 1977.

Research Disclosure Journal July, 1979; Page 352, No. 18318; Disclosed By: Swapceinski.

Co-pending U.S. patent application Ser. No. 111,450; Filed: Jan. 11, 1980; Applicant: Kopko et al.

Co-pending U.S. patent application Ser. No. 155,889; Filed: June 2, 1980, now abandoned; Applicant: Hays.

Co-pending U.S. patent application Ser. No. 169,543; Filed: July 17, 1980, now abandoned; Applicant: Hatch.

The pertinent portions of the foregoing disclosures may be briefly summarized as follows:

Armstrong et al. discloses an electrophotographic printing machine having a magnetic brush developer roller contacting one side of a flexible photoconductive belt. As shown in FIG. 3, guide rollers maintain a portion of the belt in a slackened condition in the development zone so that the belt is capable of movement freely toward and away from the developer roller in response to the varying contours thereof.

Swapceinski describes an electrophotographic printing machine including a gimbled back-up roller engaging the backside of a photoconductive belt. The back-up roller is opposed from the developer roller to compensate for relative changes in the thickness of the developer material on the developer roller, as well as maintaining constant pressure in the nip between the developer roller and photoconductive belt.

Kopko et al. describes an electrophotographic printing machine in which developer material on a developer roller deforms a tension photoconductive belt so as to space the developer roller from the belt.

In Hays, an insulating two component developer material is contained in a highly agitated development zone. This permits the continual development of high quality images including solid areas.

Hatch discloses an electrophotographic printing machine in which developer material on a developer roller spaces the photoconductive belt therefrom. The thickness of the layer of developer material on the developer roller is adjustable to control the spacing between the photoconductive belt and the developer roller.

In accordance with the features of the present invention, there is provided an apparatus for developing a latent image recorded on a rigid member. Flexible means, positioned closely adjacent to the rigid member defining a development zone therebetween, transport developer material into contact with the rigid member in the development zone. Means are provided for maintaining the flexible means at a preselected tension of sufficient magnitude to compress the developer material being transported into contact with the rigid member and to space the flexible means therefrom.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
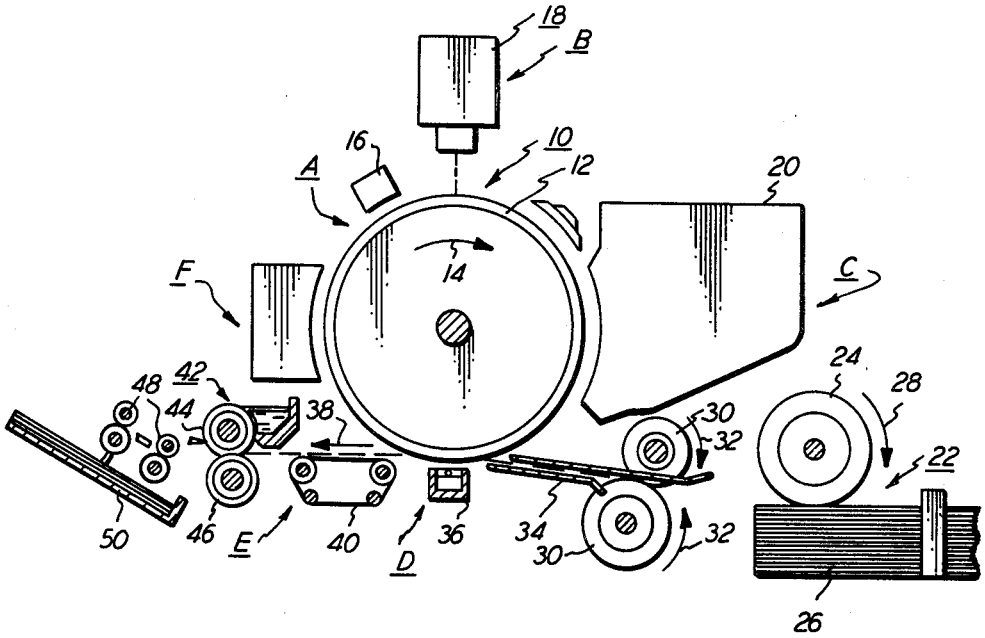
FIG. 1 is a schematic elevational view depicting an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this development apparatus is equally well suited for use in a wide variety of electrostatographic printing machines, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a selenium alloy adhering to a conductive substrate. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high substantially uniform potential.

Next, the charged portion of photoconductive surface 12 is advanced through exposure station B. Exposure station B includes an exposure system, indicated generally by the reference numeral 18. At exposure system 18, an original document is positioned facedown upon a transparent platen. Light rays reflected from the original document are transmitted through a lens to form a light image thereof. The light image is focused on the charged portion of photoconductive surface 12 to selectively dissipate the charge thereon. This records an electrostatic latent image on photoconductive surface 12 which corresponds to the informational areas contained within the original document.

Thereafter, drum 10 advances the electrostatic latent image recorded on photoconductive surface 12 to development station C. At development station C, a magnetic brush development system, indicated generally by the reference numeral 20, advances developer material into contact with the electrostatic latent image. The latent image attracts the toner particles from the carrier granules of the developer material to form a toner powder image on photoconductive surface 12 of drum 10. The detailed structure of development system 20 will be described hereinafter with reference to FIGS. 2 and 3.

Drum 10 then advances the toner powder image to transfer station D. At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roll 24 rotates in the direction of arrow 28 so as to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 so that the toner powder image developed thereon contacts the advancing sheet at transfer station D.

Preferably, transfer station D includes a corona generating device 36 which sprays ions onto the back side of the sheet. This attracts the toner powder image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred toner powder image to the sheet. Preferably, fuser assembly 42 includes a heated fuser roller 44 and a backup roller 46. The sheet passes between fuser roller 44 and backup roller 46 with the toner powder image contacting fuser roller 44. In this manner, the toner powder image is permanently affixed to the sheet. After fusing, forwarding rollers 48 advance the sheet to catch tray 50 for subsequent removal from the printing machine by the operator.

Invariably, after the sheet of support material is separated from the photoconductive surface 12 with drum 10, some residual particles remain adhering thereto. These residual particles are removed from photoconductive surface 12 at cleaning station F. Preferably, cleaning station F includes a rotatably mounted brush in contact with the photoconductive surface. The particles are cleaned from the photoconductive surface by the rotation of the brush in contact therewith. Subsequent to cleaning, a discharge lamp floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
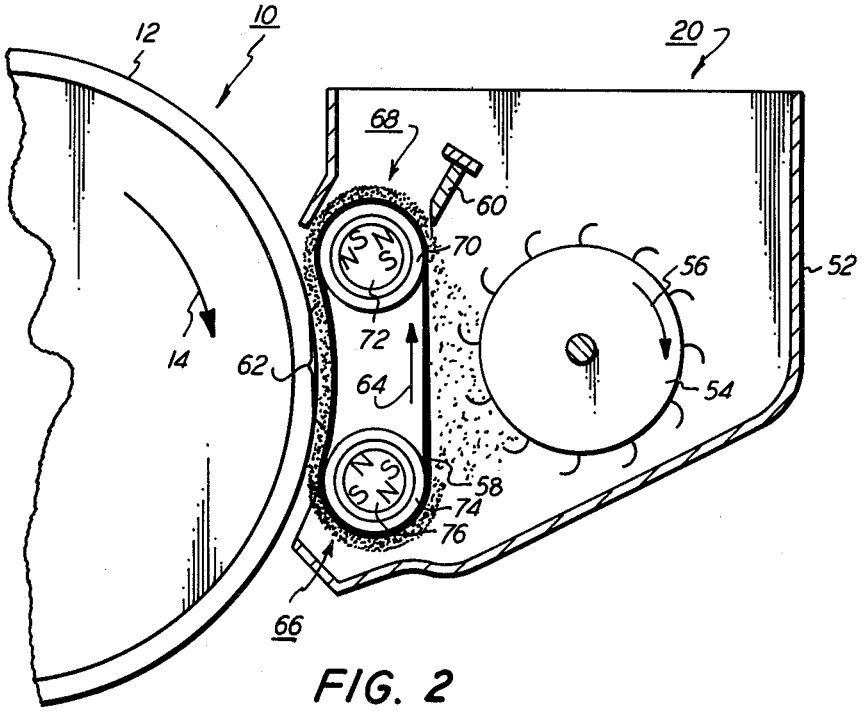
FIG. 2 is an elevational view illustrating the development system used in the FIG. 1 printing machine.

Referring now to the specific subject matter of the present invention, as shown in FIG. 2, development system 20 includes a housing 52 defining a chamber for storing a supply of developer material therein. A cylindrical member 54, mounted rotatably in the chamber of housing 52, includes a plurality of vanes extending outwardly therefrom so as to act as a paddle wheel when rotating in the direction of arrow 56. In this way, cylindrical member 54 advances the developer material to developer belt 58. A metering blade 60 is positioned closely adjacent to developer belt 58 defining a gap therebetween through which the developer material passes. This gap regulates the quantity of developer material being advanced into development zone 62 as developer belt 58 moves in the direction of arrow 64. Preferably, one end portion of metering blade 60 extends in a longitudinal direction extending substantially across the width of belt 58 so as to provide a uniform gap controlling the quantity of developer material being moved into development zone 62. The other end portion of metering blade 60 is secured to development housing 52. Belt 58 is entrained about opposed, spaced magnetic rollers, indicated generally by the reference numerals 66 and 68. Magnetic rollers 66 and 68 are substantially identical to one another with magnetic roller 68 being positioned in the entrance to the development zone 62 and magnetic roller 66 being located in the exit zone of development zone 62. Preferably, magnetic roller 66 is mounted resiliently to tension belt 58. Magnetic roller 66 includes a non-magnetic tubular roll 70 journaled for rotation. By way of example, tubular roll 70 is made from aluminum. An elongated magnet 72 is positioned concentrically within tubular roll 70 being spaced from the interior circumferential surface thereof. Magnet 72 has a plurality of magnetic poles impressed thereon. Preferably, magnet 72 is made from barium ferrite. No magnetic poles are impressed on magnet 72 in the region adjacent the development zone 62. In this way, the magnetic poles generate a strong magnetic field in the development zone entrance and a weak or substantially no magnetic field in the development zone itself. The strength of the magnetic field in the development zone is preferably less than 100 gauss. Similarly, magnetic roller 66 includes a tubular roll 74 having an elongated magnet disposed concentrically therein and spaced therefrom. Tubular roll 74 is also made from aluminum with magnet 76 being made from barium ferrite. Magnet 76 has a plurality of magnetic poles impressed thereon with the region adjacent the development zone having substantially no magnetic poles. Thus, the exit region of the development zone has a strong magnetic field with the development zone itself having a weak magnetic field. It is thus clear that both the exit and entrance regions to the development zone have strong magnetic fields with the development zone itself having a substantially weaker magnetic field. Preferably, the development zone is a field free region. A motor (not shown) rotates tubular member 70 to advance belt 58 in the direction of arrow 64. Tubular member 74 is journaled to rotate freely and acts as an idler roller. As belt 58 moves in the direction of arrow 64, developer material is attracted to the surface thereof. The developer material is advanced on belt 58 into contact with the photoconductive surface 12 of drum 10 in development zone 62. The compressed pile height of the developer material in development zone 62 ranges from about 0.04 centimeters to about 0.15 centimeters. The brush of developer material in development zone 62 causes belt 58 to deflect. Preferably, belt 58 is deflected in development zone 62 so as to form an arc about drum 10. The deflection arc ranges from about 10° to about 40°. In the development zone, the toner particles are attracted from the carrier granules to the electrostatic latent image forming a toner powder image on photoconductive surface 12. Preferably, belt 58 is made from a flexible conductive web such as Mylar having a conductive textured coating thereon. Belt 58 is electrically biased by a voltage source (not shown) to a suitable polarity and magnitude, preferably to a level intermediate that of background voltage level and the image voltage level recorded on the photoconductive surface of belt 10. By way of example, the voltage source preferably electrically biases belt 58 to a voltage ranging from about 50 volts to about 350 volts.

After the electrostatic latent image has been developed, the unused developer material and denuded carrier granules fall from belt 58 back to the chamber of housing 52. These materials are intermingled with fresh developer material and additional toner particles to form a new supply of developer material which is advanced by cylindrical member 54 onto belt 58. Additional toner particles may be furnished to developer housing 52 by an externally mounted toner supply housing (not shown). The housing periodically furnishes additional toner particles to the developer material when the concentration thereof is below a prescribed level.

Preferably, the developer material includes carrier granules having a ferromagnetic core overcoated with a non-continuous layer of resinous material. Suitable resins include poly(vinylidenefluoride) and poly(vinylidene fluorodeco-tetrafluorethylene). The developer materials can be prepared by mixing the carrier granules with the toner particles. Generally, any of the toner particles known in the art are suitable for mixing with the carrier granules. Suitable toner particles are prepared by finely grinding a resinous material and mixing it with coloring material. By way of example, the resinous material may be a vinyl polymer such as a polyvinyl chloride, polyvinylidene chloride, polyvinyl acetate, polyvinly acetals, polyvinyl ether and poly acrylic. Suitable coloring materials may be amongst others chromegen black and solvent black. The developer material comprises about 95 to about 99% by weight of carrier granules and from about 5% to about 1% by weight of toner particles. These and other materials are disclosed in U.S. Pat. No. 4,076,857 issued to Kasper et al. in 1978, the relevant portions thereof being hereby incorporated into the present application.

Figure 3:
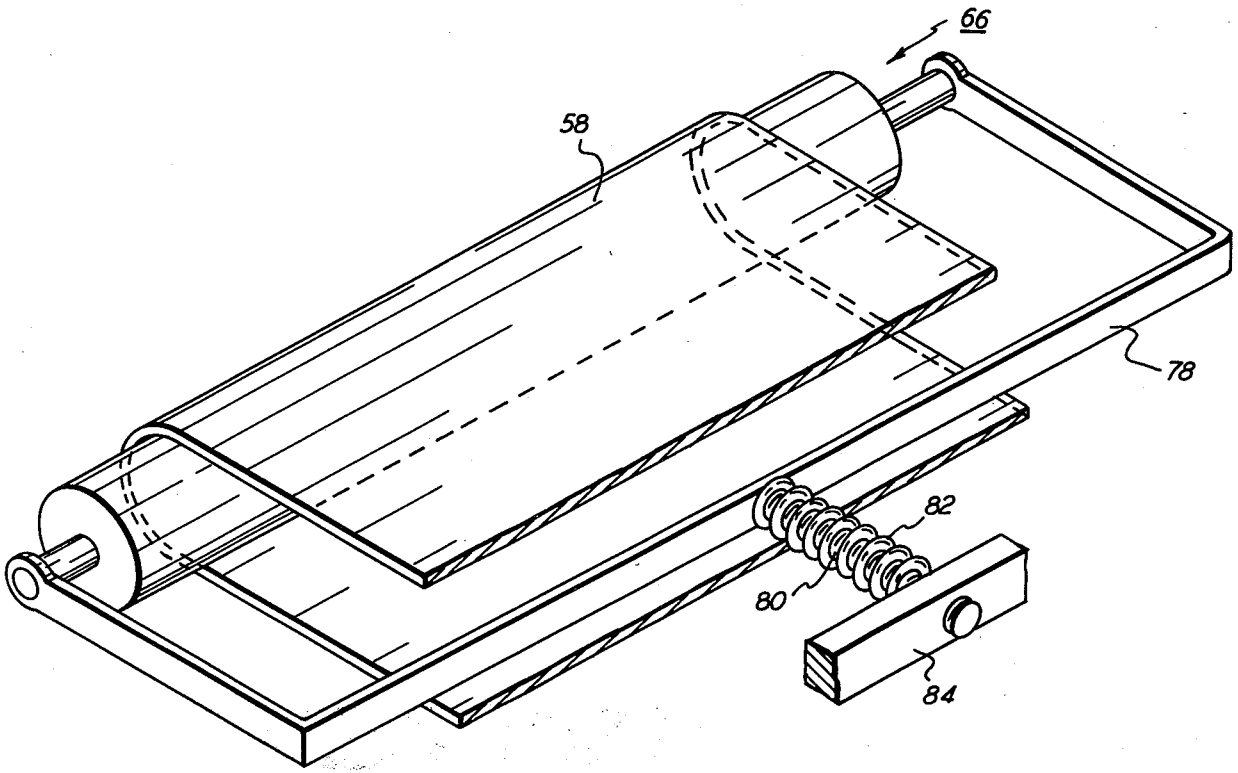
FIG. 3 is a fragmentary, perspective view showing the belt tensioning arrangement for the FIG. 2 development system.

Referring now to FIG. 3, there is shown a system for tensioning belt 58 in greater detail. As shown thereat, roller 66 is mounted in suitable bearings in a yoke, indicated generally by the reference numeral 78. Preferably, yoke 78 includes a U-shaped portion supporting roller 66 and a rod 80 secured to the midpoint of the cross member of U-shaped member 78. Coil spring 82 is wrapped around rod 80. Rod 80 is mounted slidably in frame 84 secured fixedly to developer housing 52. Spring 82 is compressed between yoke 78 and frame 84. Compressed spring 82 resiliently urges yoke 78 and, in turn, roller 66 against belt 58. Spring 82 is designed to have an appropriate spring constant such that when placed under the desired compression, belt 58 is tensioned to about 0.1 kilogram per linear centimeter. Belt 58 is maintained under a sufficiently low tension to enable the developer material disposed in development zone 62 (FIG. 2) to deflect belt 58 through an arc ranging from about 10° to about 40°. This extended arc comprises development zone 62 (FIG. 2).

In recapitulation, it is clear that the development apparatus of the present invention has a developer belt positioned closely adjacent to a rigid photoconductive drum so as to transport developer material into contact with the electrostatic latent image recorded thereon. The belt is maintained at a pre-selected tension of sufficient magnitude to enable the developer material being transported into contact with the photoconductive drum to deflect the belt in the development zone. In this manner, the belt deflects to define an extended development zone which significantly improves development of the electrostatic latent image.

It is, therefore, evident that there has been provided in accordance with the present invention, an apparatus for developing an electrostatic latent image that improves development while reducing the required amount of developer material used therefore. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image recorded on a rigid member, including:

a flexible belt;

a pair of opposed, spaced rollers generating a magnetic field with said belt movably supported thereon, said belt having at least a portion thereof positioned closely adjacent to the rigid member defining a development zone therebetween, for transporting developer material attracted thereto by said pair of rollers into contact with the rigid member in the development zone so as to develop the latent image recorded thereon; and means for maintaining said belt at a pre-selected tension of sufficient magnitude to compress the developer material being transported into contact with the rigid member and to space said belt therefrom.

2. An apparatus according to claim 1, wherein the rigid member is a drum.

3. An apparatus according to claim 2, wherein said belt includes an arcuate region in the development zone ranging from about 10° to about 40°.

4. An apparatus according to claim 3, wherein one of said pair of rollers is positioned at the entrance to the development zone with the other of said pair of rollers being positioned at the exit to the development zone so as to generate strong magnetic fields in the region of the development zone entrance and exit with the development zone being substantially free of a magnetic field.

5. An apparatus according to claim 4, wherein said maintaining means tensions said belt to a magnitude preferably of about 0.1 kilograms per linear centimeter.

6. An apparatus according to claim 4, further including means for regulating the quantity of developer material being transported into the development zone by said belt.

7. An electrophotographic printing machine of the type having an electrostatic latent image recorded on a rigid photoconductive member, wherein the improvement includes:

a flexible belt;

a pair of opposed, spaced rollers generating a magnetic field with said belt being movably supported thereon, said belt having at least a portion thereof positioned closely adjacent to the photoconductive member defining a development zone therebetween, for transporting developer material attracted thereto by said pair of rollers into contact with the photoconductive member in the development zone so as to develop the latent image recorded thereon; and means for maintaining said belt at a pre-selected tension of sufficient magnitude to compress the developer material being transported into contact with the photoconductive member and to space said belt therefrom.

8. A printing machine according to claim 7, wherein the photoconductive member is a drum.

9. A printing machine according to claim 8, wherein said belt includes an arcuate region in the development zone ranging from about 10° to about 40°.

10. A printing machine according to claim 9, wherein one of said pair of rollers is positioned at the entrance to the development zone with the other of said pair of rollers being positioned at the exit from the development zone so as to generate strong magnetic fields in the region of the development zone entrance and exit with the development zone being substantially free of a magnetic field.

11. A print machine according to claim 9, wherein said maintaining means tensioned said belt to a magnitude preferably of about 0.1 kilograms per linear centimeter.

12. A printing machine according to claim 9, further including means for regulating the quantity of developer material being transported into the development zone by said belt.

* * * * *